US008376165B2

(12) United States Patent
Chiang

(10) Patent No.: US 8,376,165 B2
(45) Date of Patent: Feb. 19, 2013

(54) DRINKING CONTAINER HAVING SLIDABLE COVER AND DRINKING STRAW

(76) Inventor: Yat San Chiang, Hong Kong (CN)

( * ) Notice: Subject to any disclaimer, the term of this patent is extended or adjusted under 35 U.S.C. 154(b) by 64 days.

(21) Appl. No.: 13/113,023

(22) Filed: May 20, 2011

(65) Prior Publication Data

US 2012/0160851 A1 Jun. 28, 2012

(30) Foreign Application Priority Data

Dec. 23, 2010 (CN) ..... 2010 1 0602625

(51) Int. Cl.
*B65D 77/28* (2006.01)
*B65D 90/60* (2006.01)

(52) U.S. Cl. ..... 215/388; 215/229; 215/322; 220/212; 220/254.9; 220/345.1; 220/360; 220/707; 220/709; 222/560

(58) Field of Classification Search ..... 215/229, 215/322, 388, 389; 220/212, 254.9, 345.1, 220/360, 705, 707–709; 222/560; 229/103.1; 239/33
See application file for complete search history.

(56) References Cited

U.S. PATENT DOCUMENTS

| | | | | | |
|---|---|---|---|---|---|
| 577,987 | A * | 3/1897 | Nuckols et al. | ..... | 222/517 |
| 2,073,707 | A * | 3/1937 | Parkin | ..... | 222/560 |
| 2,152,271 | A * | 3/1939 | Nyden | ..... | 222/484 |
| 2,256,095 | A * | 9/1941 | Maloney | ..... | 222/560 |
| 2,480,733 | A * | 8/1949 | Hermani | ..... | 222/560 |
| 2,575,083 | A * | 11/1951 | Abraham | ..... | 222/86 |
| 2,575,106 | A * | 11/1951 | Hermani | ..... | 222/517 |
| 2,851,204 | A * | 9/1958 | Schwab | ..... | 222/545 |
| 2,858,054 | A * | 10/1958 | Harkrader | ..... | 222/553 |
| 2,866,580 | A * | 12/1958 | Nissen | ..... | 222/512 |
| 4,684,043 | A * | 8/1987 | Foster et al. | ..... | 222/386 |
| 5,188,283 | A * | 2/1993 | Gu | ..... | 229/103.1 |
| 6,076,729 | A * | 6/2000 | Cornell et al. | ..... | 229/103.1 |
| 6,354,454 | B1 * | 3/2002 | Wong | ..... | 220/345.1 |
| D477,532 | S * | 7/2003 | Wong | ..... | D9/449 |
| 6,752,287 | B1 * | 6/2004 | Lin | ..... | 220/254.9 |
| 6,824,003 | B1 * | 11/2004 | Wong | ..... | 220/254.9 |
| 6,945,425 | B1 * | 9/2005 | Kim | ..... | 220/706 |
| D584,102 | S * | 1/2009 | Valderrama et al. | ..... | D7/392.1 |
| D591,103 | S * | 4/2009 | Wong | ..... | D7/396.2 |
| 7,591,389 | B2 * | 9/2009 | Wong | ..... | 220/254.9 |
| 7,611,029 | B2 * | 11/2009 | Wong | ..... | 220/254.9 |
| 7,845,510 | B2 * | 12/2010 | Schmidtner et al. | ..... | 220/254.9 |
| 7,850,037 | B2 * | 12/2010 | Schmidtner et al. | ..... | 220/713 |
| 7,874,447 | B2 * | 1/2011 | Schmidtner et al. | ..... | 220/254.9 |

* cited by examiner

*Primary Examiner* — J. Gregory Pickett
*Assistant Examiner* — Ned A Walker

(57) ABSTRACT

A drink container with suction pipe is provided. The container comprises a container body, a cap assembly and a flexible straw; the cap assembly comprises an inner cap and a valve assembly which can open and close the passage between inside and outside of the container body by respectively extending and bending the flexible straw; and the cap assembly also comprises a venting switch assembly which comprises a venting valve hole mounted on the inner cap, a float venting valve, protrusions mounted respectively on both ends of the inner side of the slide sheet, and hollow portion mounted between two the protrusions. The float venting valve is movably mounted to the venting valve hole and comprises one or a plurality of elastic protrusions on its contact surface. When the slide sheet is in its completely open or closed position, one of the protrusions mounted on both ends of the inner side of the slide sheet is pressed against the float venting valve to press the elastic protrusion of the float venting valve to cling to the surface of the venting valve hole for waterproof sealing. Therefore, the requirement to the process dimension of assembling of the venting switch assembly in accordance with this invention is lower, and the float venting valve is easy to be replaced.

9 Claims, 9 Drawing Sheets

DRINKING CONTAINER HAVING SLIDABLE COVER AND DRINKING STRAW

FIELD OF THE INVENTION

The present invention relates to drinking containers with suction pipe, and more particularly to drinking containers which can prevent hot liquids spouting out of the open end of the straw when hot liquids are contained therein.

BACKGROUND OF THE INVENTION

Drinking containers for consumption using straws are known. When hot liquids are contained in these containers with prior structures, air pressure in the containers will be heighten because of heat, which results in that the hot liquids are prone to spouting out of the open end of the straw when it is open. In order to solve this problem, it is necessary to mount a ventilating device on inner cap. For example, Chinese patent CN200610165636.7 discloses a cap for drink container and a drink container, wherein a valve with air vent is mounted on the inner cap for ventilating, and two valve cores are mounted on a slide sheet in order that the valve cores will block up the air vent of the valve to seal up water when the valve is in its open and closed positions. While this structure should be assembled exactly to ensure that the air vent on the valve and the valve cores are positioned accurately, and it is not convenient to replace the valve body with this structure when it is worn down or burnt if it is fixed on the inner cap. It is, therefore, necessary to provide a drink container with suction pipe with structure for ventilating to prevent hot liquids and vapors spouting out when the straw is open, which is also simply structured, easy to be disassembled and assembled, and easy to be cleaned.

SUMMARY OF THE INVENTION

An object of this invention is to supply a drink container with suction pipe with structure for ventilating to prevent hot liquids spouting out when the straw is open, which is also simply structured, easy to be disassembled and assembled, and easy to be cleaned.

In order to obtain the abovementioned object, this invention employs the following technical proposals:

A drink container with suction pipe comprising a container body, a cap assembly and a flexible straw; the cap assembly comprising an inner cap and a valve assembly which can open and close the passage between inside and outside of the container body by respectively extending and bending the flexible straw; the inner cap being mounted to the opening of the container body by waterproof sealing; the valve assembly comprising a slidable slide sheet which is positioned and mounted on the outer side of the inner cap, and a bending fulcrum unit which sustains against the bending portion of the straw which is mounted to the mounting hole for straw of the inner cap by waterproof sealing; when the slide sheet slides freely forward to press the bending portion of the straw, the straw being bent from the bending fulcrum unit to close the passage; and when the slide sheet slides freely backward, the straw returning to upstanding position to communicate inside with outside;

the cap assembly also comprises a venting switch assembly which comprises a venting valve hole mounted on the inner cap, a float venting valve, protrusions mounted respectively on both ends of the inner side of the slide sheet, and hollow portion mounted between two the protrusions; the float venting valve is movably mounted to the venting valve hole and comprises one or a plurality of elastic protrusions on its contact surface; when the slide sheet is in its completely open or closed position, one of the protrusions mounted on both ends of the inner side of the slide sheet is pressed against the float venting valve to press the elastic protrusion of the float venting valve to cling to the surface of the venting valve hole for waterproof sealing; and during the slide sheet is being open, the float venting valve is positioned in the hollow portion of the inner side of the slide sheet to make the float venting valve be spaced from the slide sheet, and the elastic protrusion recovers to form a venting passage between the float venting valve and the venting valve hole which communicates the interior of the container body with outside atmosphere.

The float venting valve is formed to a T-shaped structure, the venting valve hole is a T-shaped through hole, and the elastic protrusions are mounted on the annular contact surface of the T-shaped structure of the float venting valve.

A plurality of the elastic protrusions are mounted symmetrically and equally on the annular contact surface of the T-shaped structure of the float venting valve.

The elastic protrusions are made of medical transparent silica gel.

The float venting valve and the elastic protrusions are formed jointly to one component.

The cap assembly comprises a depositing portion for depositing the opening end of the straw, and the opening end is bent and deposited in the depositing portion when the straw is bent by the slide sheet pressing the bending portion of the straw.

The cap assembly also comprises a fixing ring; the slide sheet is mounted in a guide slideway which is mounted on the outer surface of the inner cap, and the fixing ring is covered from above of the inner cap and assembled with the inner cap in place to fix the slide sheet.

A connecting tube for being stuck into liquid drink is connected to a lower mounting hole of the straw.

The inner cap is engaged to the opening of the container body by screw thread structure, and a seal ring made of silica gel is mounted between the inner cap and the opening of the container body.

For the abovementioned structures utilized, during the slide sheet is being open, the float venting valve is flicked under the action of the elastic protrusions, and high-pressured air in the interior is discharged through the venting passage between the float venting valve and the venting valve hole, and the pressure in the container is balanced. When the slide sheet is completely open or closed, the two protrusions on the slide sheet press tightly against the float venting valve, and the elastic protrusion is forced to cling to the contact surface of the venting valve hole for waterproof sealing. The requirement to the process dimension of assembling is lower, as the float venting valve can be waterproof sealed only by the two protrusions on the slide sheet pressing against the upper of the float venting valve; and the float venting valve van be easily replaced when damaged, as the float venting valve is movably inserted in the venting valve hole. In addition, the technical solution of the present invention has the following advantages comparing with prior art: 1. The products according to the present invention can be made of innoxious materials, meeting the health standard of FDA of USA and EN71 of Europe; 2. the structures of the products in accordance with the present invention are detachable, and therefore is easy to be cleaned and is convenient to use; 3. the products in accordance with the present invention can prevent hot liquid from leaking and spouting during use, and ensure safety of users.

DETAILED DESCRIPTION OF THE PREFERRED EMBODIMENT

Figure 1:
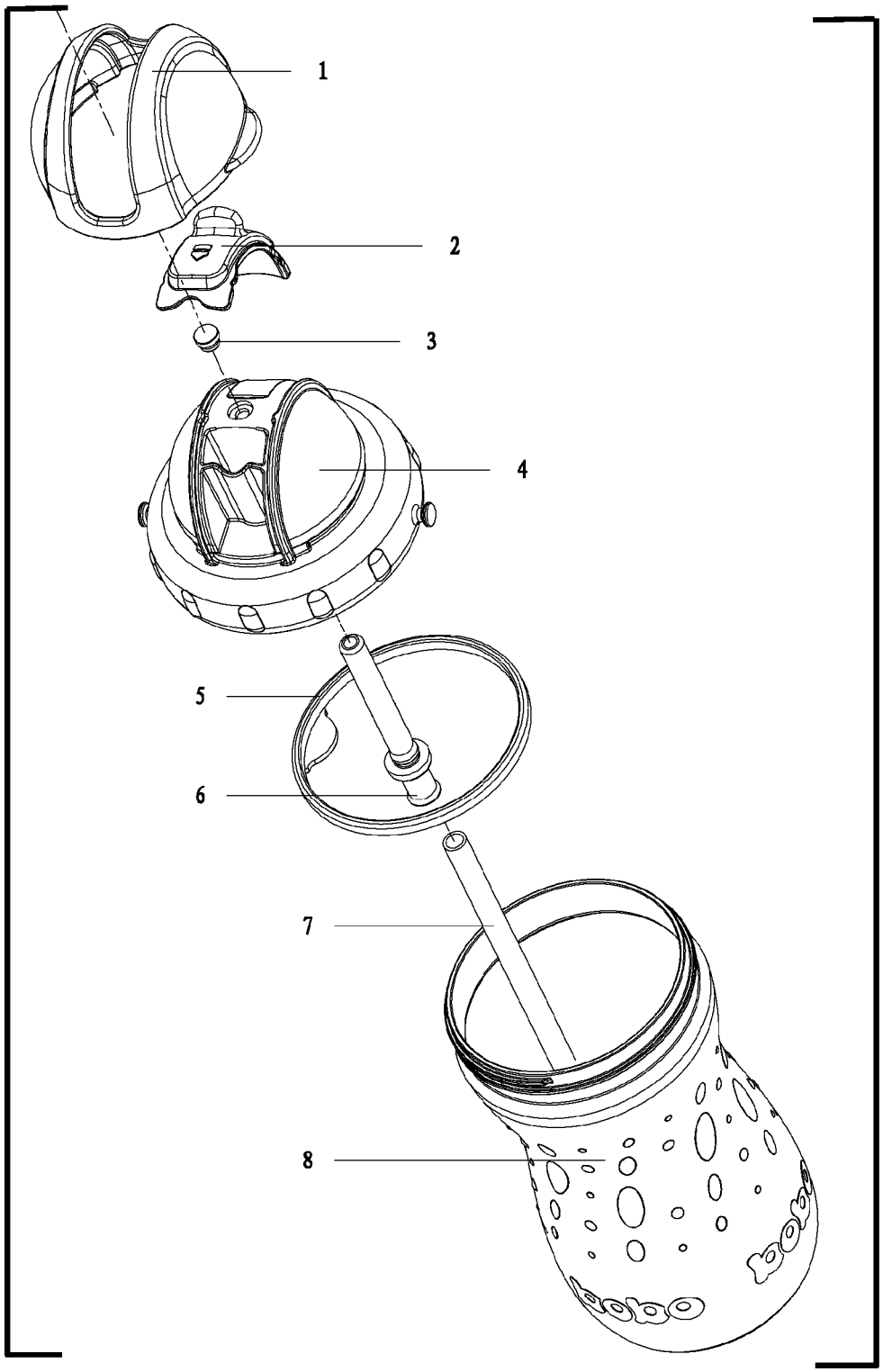
FIG. 1 is an exploded perspective view of a drink container in accordance with this invention.
Figure 2:
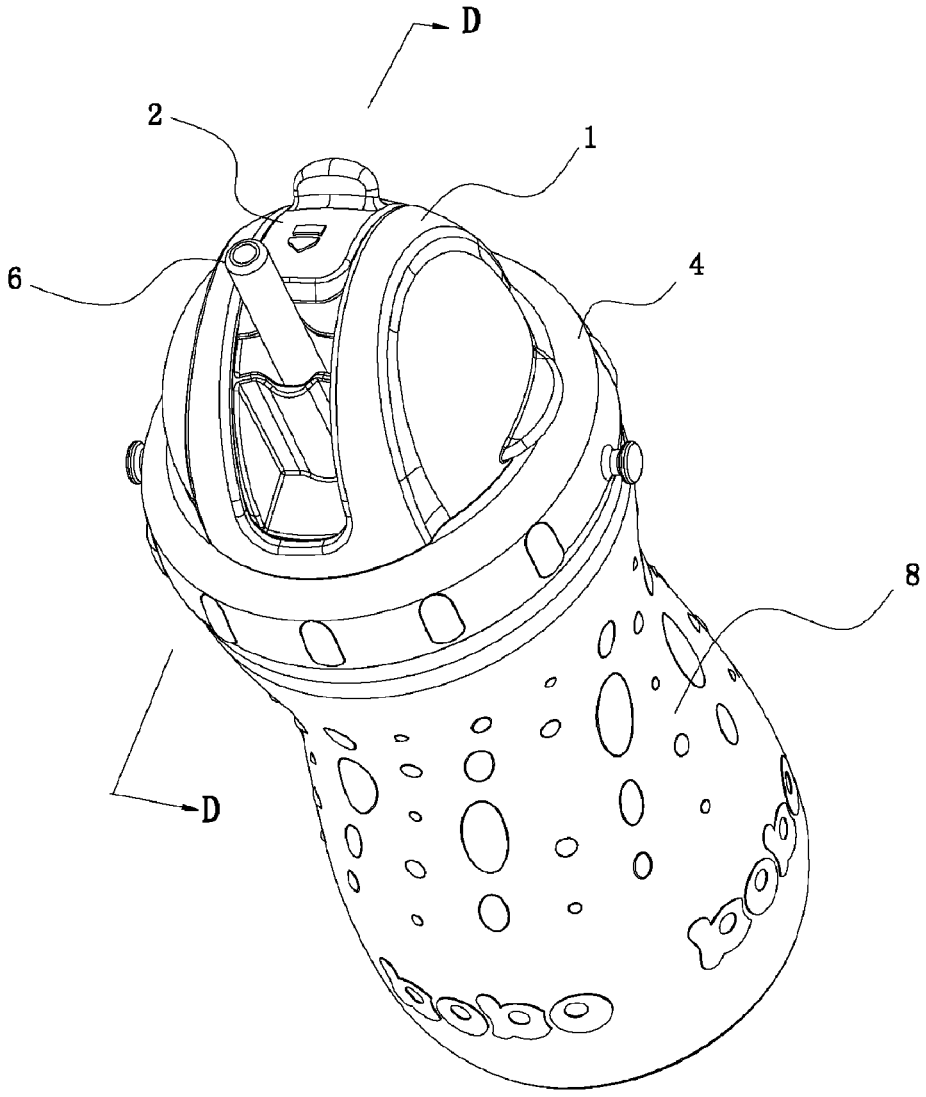
FIG. 2 is a perspective view of a drink container in accordance with this invention.
Figure 3:
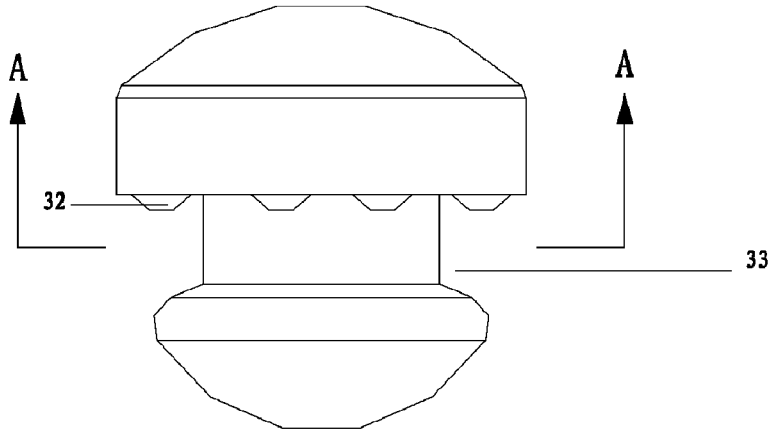
FIG. 3 is a first structural diagrammatic sketch of a float venting valve of a drink container in accordance with this invention.
Figure 4:
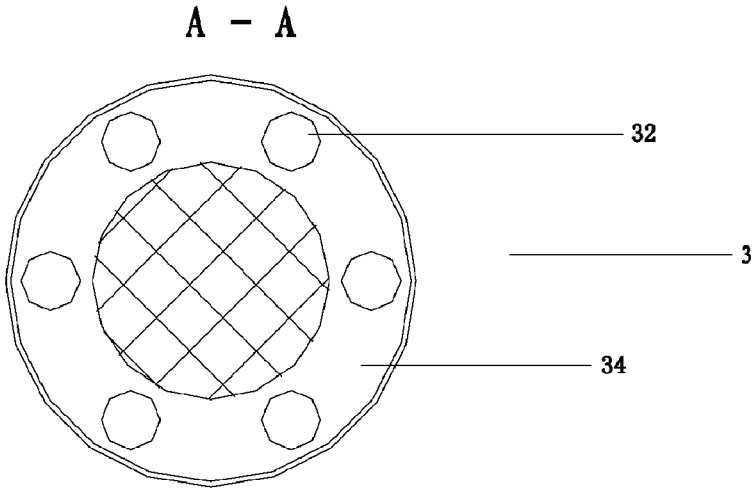
FIG. 4 is A-A sectional view of FIG. 3.
Figure 5:
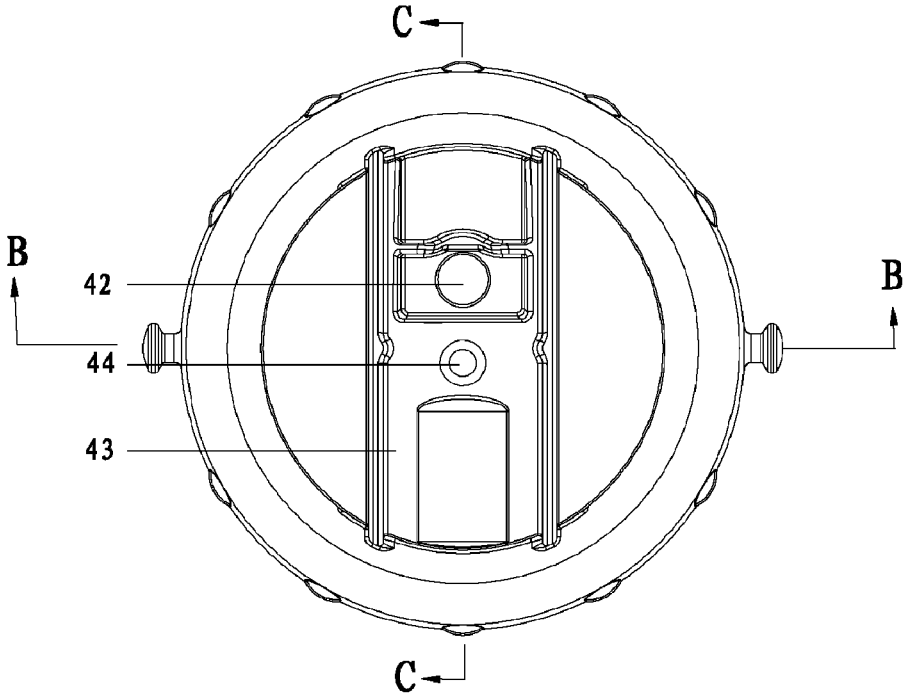
FIG. 5 is a first structural diagrammatic sketch of assembled float venting valve and inner cap.
Figure 6:
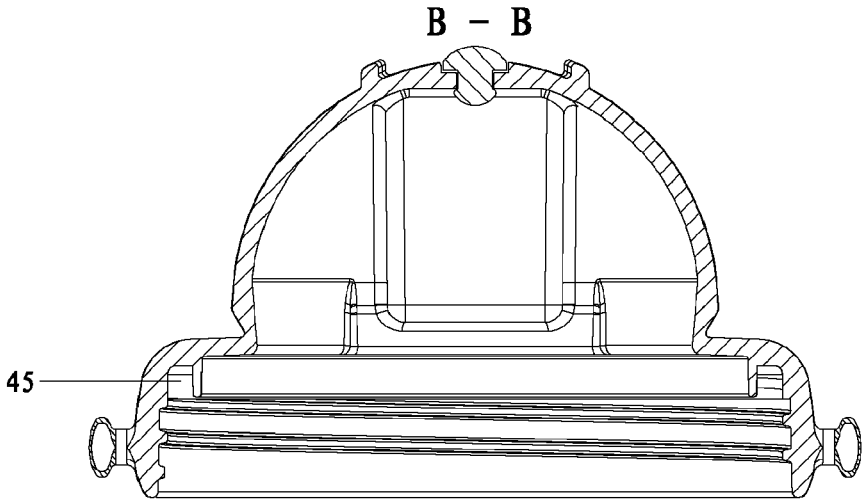
FIG. 6 is a second structural diagrammatic sketch of assembled float venting valve and inner cap.
Figure 7:
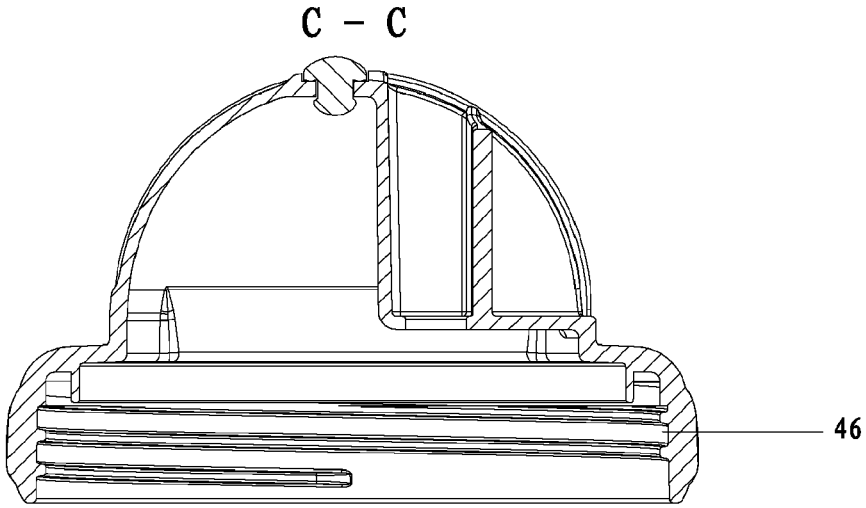
FIG. 7 is a third structural diagrammatic sketch of assembled float venting valve and inner cap.
Figure 8:
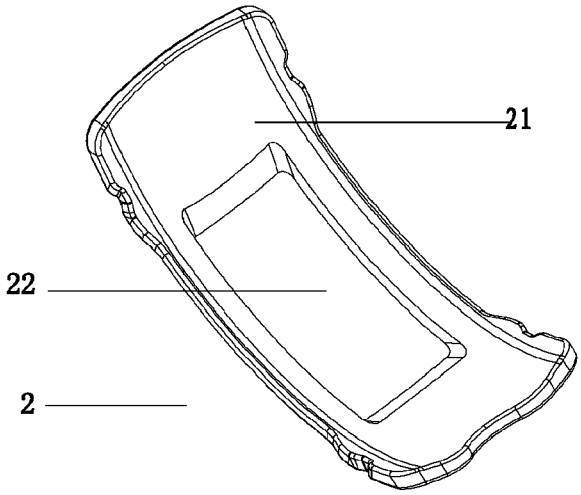
FIG. 8 is a perspective structural diagrammatic sketch of the slide sheet of a drink container in accordance with this invention.
Figure 9:
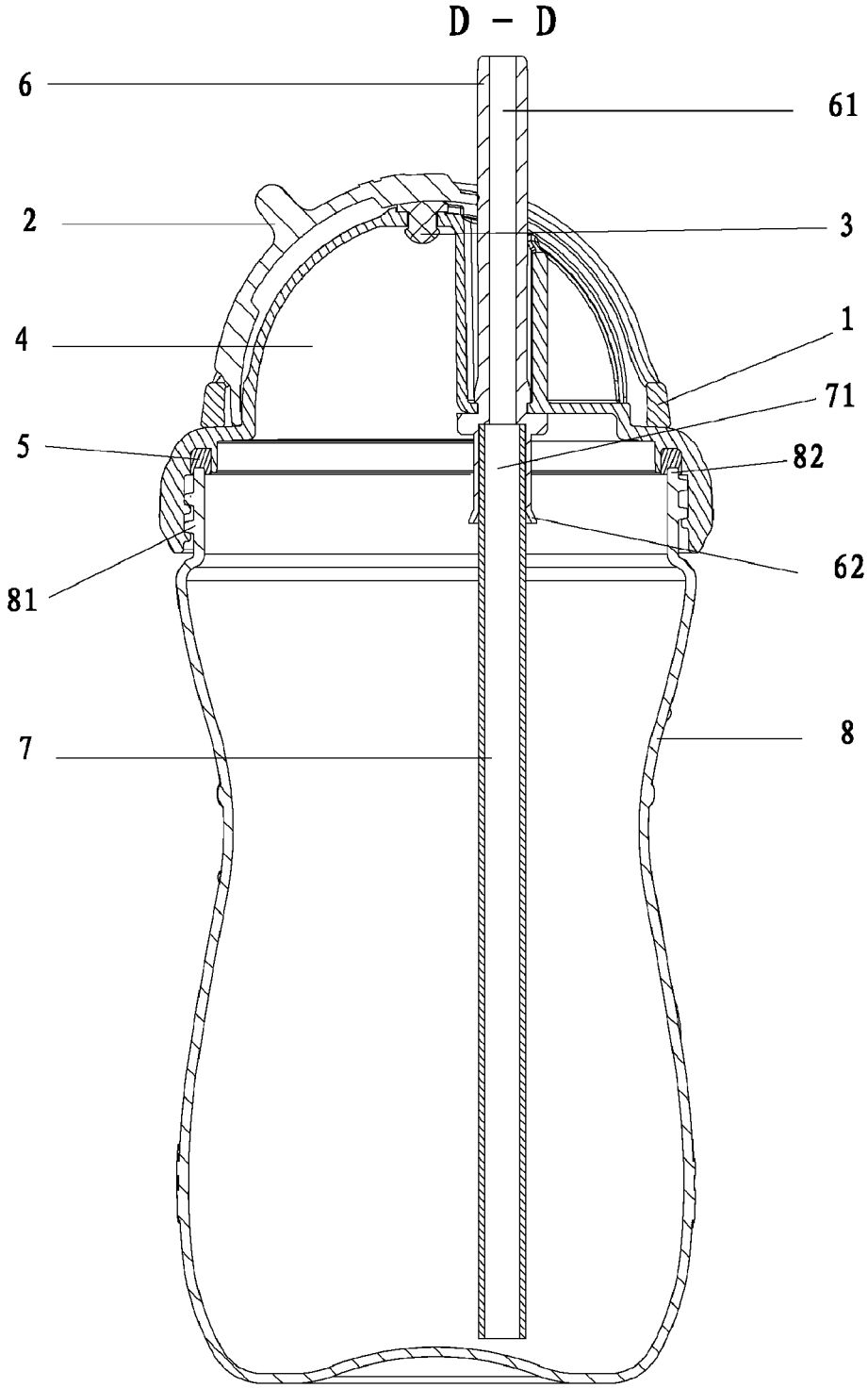
FIG. 9 is an assembled, sectional structural diagrammatic sketch of a drink container in accordance with this invention.
Figure 10:
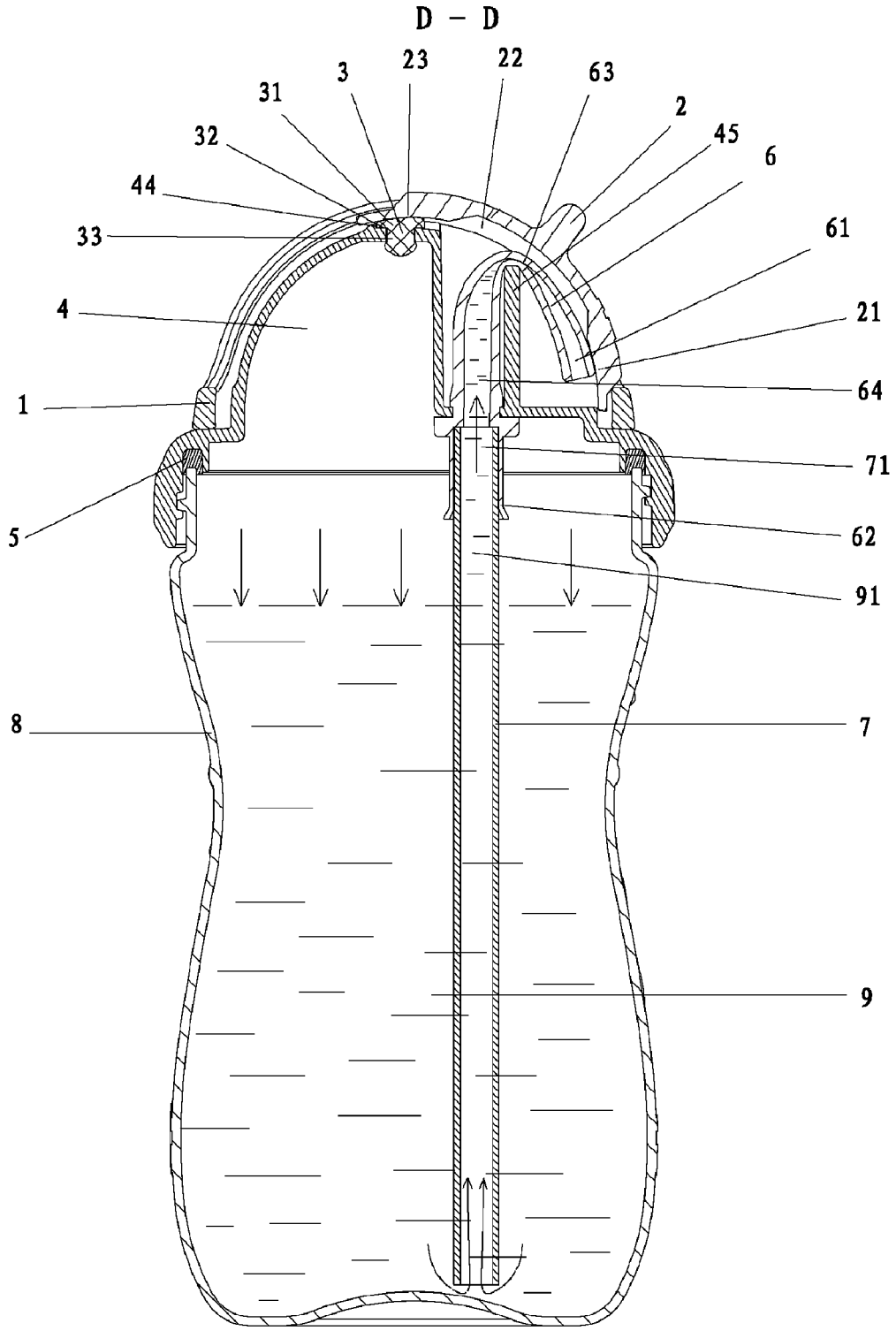
FIG. 10 is an assembled, sectional structural diagrammatic sketch of a drink container in closed position in accordance with this invention.
Figure 11:
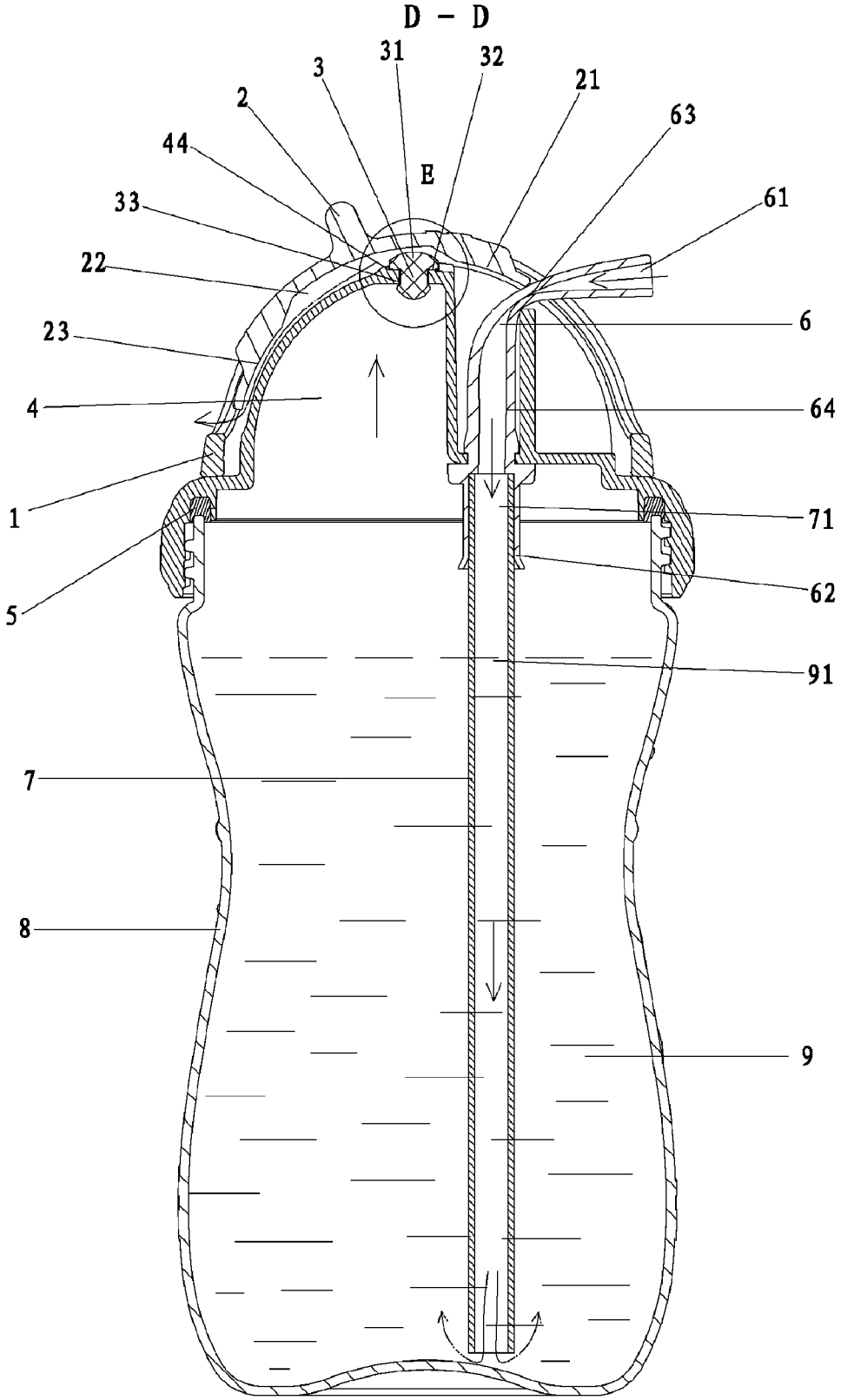
FIG. 11 is an assembled, sectional structural diagrammatic sketch of a drink container which is open for ventilating in accordance with this invention.
Figure 12:
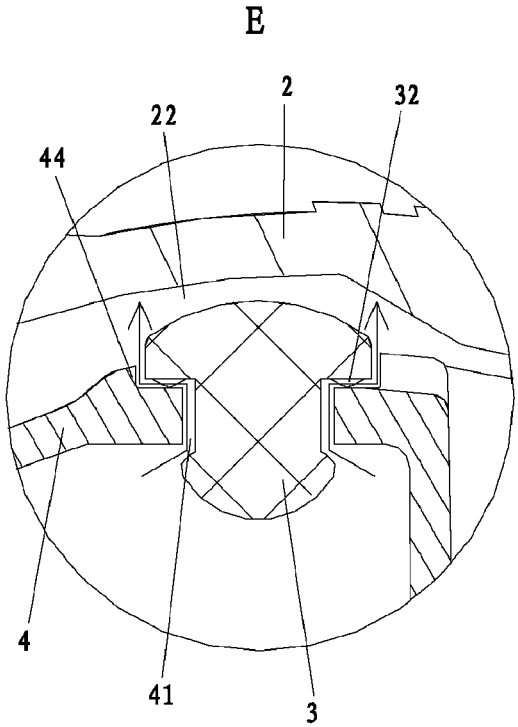
FIG. 12 is a partial enlarged drawing of FIG. 11.
Figure 13:
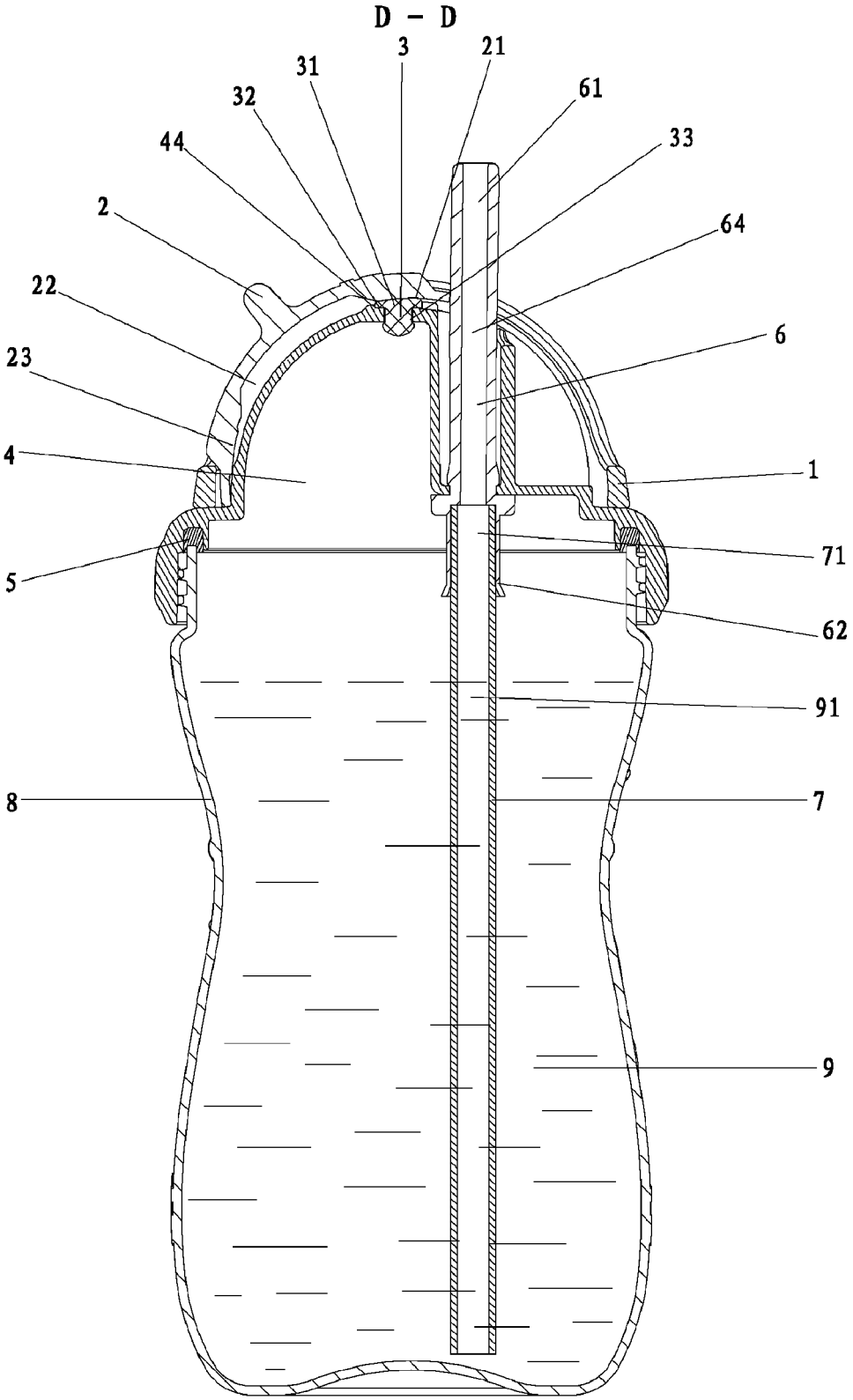
FIG. 13 is an assembled, sectional structural diagrammatic sketch of a drink container which is completely open in accordance with this invention.

As seen in FIGS. 1 to 13, a drink container with suction pipe comprises a container body 8, a cap assembly and a flexible straw 6, and the cap assembly comprises a inner cap 4 and a valve assembly which can open and close the passage between inside and outside of the container body 8 by respectively extending and bending the flexible straw 6. The inner cap 4 is mounted on the opening of the container body 8 by waterproof sealing, and the valve assembly comprises a slidable slide sheet 2 which is positioned and mounted on the outer side of the inner cap 4 and a bending fulcrum unit 45 which sustains against the bending portion of the straw 6, and the straw 6 is mounted to a mounting hole 42 for straw of the inner cap 4 by waterproof sealing. The straw 6 is bent from the bending fulcrum unit 45 when the slide sheet 2 slides freely forward to press the bending portion 63 of the straw 6; and the straw 6 returns to upstanding position to communicate to outside when the slide sheet 2 slides freely backward.

The cap assembly also comprises a venting switch assembly, and the venting switch assembly comprises a venting valve hole 44 mounted on the inner cap, a float venting valve 3, protrusions 21 and 23 mounted on both ends of the inner side of the slide sheet 2 and a hollow portion 22 mounted between the protrusion 21 and the protrusion 23. The float venting valve 3 is movably mounted over the venting valve hole 44 and comprises one or a plurality of elastic protrusions 32 on its contact surface. When the slide sheet 2 is in its completely open or closed position, one of the protrusion 21 and protrusion 23 mounted on both ends on the inner side of the slide sheet 2 is pressed on the top surface 31 of the float venting valve 3, so as to press elastic protrusion 32 to cling to the contact surface of the venting valve hole 44 for waterproof sealing. During the slide sheet 2 is being open, the float venting valve 3 is positioned in the hollow portion 22 of the inner side of the slide sheet to make the float venting valve 3 be spaced from the slide sheet 2, and the elastic protrusion 32 recovers to form a venting passage 41 between the float venting valve 3 and the venting valve hole 44 which communicates the interior of the container body and outside atmosphere.

The float venting valve 3 is formed to T-shaped structure, and the venting valve hole 44 is a T-shaped through hole, and the elastic protrusion 32 is mounted on the annular contact surface 34 of the T-shaped structure of the float venting valve.

A plurality of elastic protrusions 32 are mounted, and these elastic protrusions 32 are mounted symmetrically and equally on the annular contact surface 34 of the T-shaped structure of the float venting valve 3.

The elastic protrusions 32 are made of medical transparent silica gel.

The float venting valve 3 and the elastic protrusions 32 are formed jointly to one component.

The cap assembly comprises a depositing portion for depositing the open end 61 of the straw 6, and the open end 61 is bent and deposited in this depositing portion when the straw 6 is bent as the slide sheet 2 presses the bending portion 63 of the straw 6.

The cap assembly comprises a fixing ring 1, and the slide sheet 2 is mounted in the guide slideway 43 which is on the outer surface of the inner cap 4, and the fixing ring 1 is covered from above of the inner cap 4 and mounted in place together with the inner cap 4 to fix properly the slide sheet 2.

A connecting tube 7 for being stuck into liquid 9 is connected to a lower portion of the straw 6 which may be made of silica gel.

The inner cap 4 is engaged to the opening of the container body 8 by screw thread structure, and a water sealing ring 5 made of silica gel is connected between the inner cap 4 and the opening of the container body 8. Of course, other types of connection which can make inner cap 4 be mounted and sealed to the opening of the container body 8 is feasible.

As seen in FIGS. 5 to 9, the procedure of assembling is as follows: first fit the float venting valve 3 through the venting valve hole 44 on the inner cap 4; then place slide sheet 2 in the guide slideway 43 of the inner cap 4, and then cover the fixing ring 1 from above of the inner cap 4 and assemble it with the inner cap 4 in place to fix the slide sheet 2; then insert an end 71 of the connecting tube 7 into the connection hole 62 on the lower portion of the straw 6, and then insert the opening end 61 of the straw 6 from below to the mounting hole 42 for the straw of the inner cap 4 and mount it in place; then fix silica gel water sealing ring 5 on the mounting slot 43 for water sealing ring of the inner cap 4; and then engage the threaded end 81 of the container body 8 with the threaded portion 46 of the inner cap 4, until the open portion 82 of the container body is pressed tightly against the silica gel seal ring 5.

As seen in FIGS. 10 to 13, the function of venting and preventing from leaking and spouting is obtained from the following actions:

1. put hot liquid 9 into the container body 8 and cover the inner cap 4 which is properly mounted with all the components and which is in closed position;

2. gas in the container body 8 expands for heat, and liquid 9 flows through the connecting tube 71 and the straw 64 to the opening end of the straw under the pressure of the gas;

3. liquid 91 in the straw 6 cannot flow to the opening end 61 of the straw because the bending portion 63 of the straw 6 blocks it, and preventing from leakage;

4. while the slide sheet 2 is being open from its closed position, the protrusion 23 of an end of the slide sheet 2 is deviating from the top surface 31 of the float venting valve 3;

5. the hollow portion 22 of the slide sheet 2 does not contact the float venting valve, and the float venting valve 3 is bounced under the elasticity of the elastic protrusion 32 and therefore shifts from contacting position to suspending position;

6. gas flows through the venting passage 41 between the assembling position 33 of the float venting valve 3 and the venting valve hole 44 of the inner cap 4, to make the pressure of the interior of the container 8 be the same as that of outside;

7. liquid 91 in the straw 6 and the connecting tube 71 is reduced from higher than level to same to level;

8. when the slide sheet 2 is moved to use position, the protrusion 21 of an end of the slide sheet 2 presses tightly against the top surface 31 of the float venting valve 3;

9. under the action of the protrusion 21, the float venting valve 3 clings to the venting valve hole 44 of the inner cap 4 to prevent liquids from leaking through here during use;

10. open the straw 6 to its normal use position, and the product can be used normally;

11. after using, close the slide sheet 2 to the un-open position.

From the foregoing, the requirement to the process dimension of assembling of the venting switch assembly in accordance with this invention is lower, and the float venting valve 3 is easy to be replaced when damaged as the float venting valve 3 is movably inserted in the venting valve hole 44. In addition, the technical solution is more advantageous than the prior art in the following facets: 1. the products in accordance with this invention can be made of innoxious materials, meeting the health standard of FDA of USA and EN71 of Europe; 2. the structures of the products in accordance with this invention are detachable, and therefore is easy to be cleaned and convenient to use; 3. the products in accordance with this invention can prevent hot liquid from leaking and spouting during use, and ensure safety of users.

What is claimed is:

1. A drink container comprising:

a container body, a cap assembly, and a flexible straw; said cap assembly comprising an inner cap and a valve assembly to open and close a drinking passage between an inside and an outside of said container body by respectively extending and bending said flexible straw; said inner cap being mounted to an opening of said container body by waterproof sealing; said valve assembly comprising a slidable slide sheet which is positioned and mounted on an outer side of said inner cap, and a bending fulcrum unit pressed against a bending portion of said straw mounted within a mounting hole of said inner cap by waterproof sealing; when said slide sheet slides freely forward to press said bending portion of said straw, said straw being bent from said bending fulcrum unit to close said drinking passage; and when said slide sheet slides freely backward, said straw returning to an upstanding position to communicate said inside with said outside;

said cap assembly further comprising: a venting switch assembly comprising a venting valve hole mounted on said inner cap, a float venting valve, two protrusions mounted respectively on a first end and a second end of the inner side of said slide sheet, and a hollow portion mounted between said two protrusions; said float venting valve is movably mounted to said venting valve hole and comprises at least one elastic protrusion on its contact surface; when said slide sheet is in an open position or a closed position, one of said two protrusions is pressed against said float venting valve to press said at least one elastic protrusion of said float venting valve to waterproof seal said venting valve hole; and when said slide sheet is in said open position, said float venting valve is positioned in said hollow portion of the inner side of said slide sheet to space said float venting valve from said slide sheet, and said at least one elastic protrusion allows a venting passage between said float venting valve and said venting valve hole.

2. The drink container of claim 1, wherein said at least one elastic protrusion is made of medical transparent silica gel.

3. The drink container of claim 1, wherein said float venting valve is formed as a T-shaped structure, said venting valve hole is a T-shaped through hole, and said at least one elastic protrusion is mounted on an annular contact surface of said float venting valve T-shaped structure.

4. The drink container of claim 3, wherein said at least one elastic protrusion is a plurality of said elastic protrusions mounted symmetrically and equally on the annular contact surface of said float venting valve T-shaped structure.

5. The drink container of claim 1, wherein said float venting valve and said at least one elastic protrusion is formed jointly as one component.

6. The drink container of claim 5, wherein said cap assembly comprises a depositing portion for depositing an opening end of said straw, and said opening end is bent and deposited in said depositing portion when said straw is bent by said slide sheet pressing said bending portion of said straw.

7. The drink container of claim 6, wherein said cap assembly further comprises a fixing ring; said slide sheet is mounted in a guide slideway mounted on an outer surface of said inner cap, and said fixing ring is assembled with said inner cap to fix said slide sheet.

8. The drink container of claim 7, wherein a connecting tube is connected to a lower mounting hole of said straw.

9. The drink container of claim 8, wherein said inner cap is engaged to the opening of said container body by a screw thread structure, and a water sealing ring made of silica gel is mounted between said inner cap and the opening of said container body.

* * * * *